US009162340B2

(12) United States Patent
Joseph et al.

(10) Patent No.: US 9,162,340 B2
(45) Date of Patent: Oct. 20, 2015

(54) POLISHING PADS INCLUDING PHASE-SEPARATED POLYMER BLEND AND METHOD OF MAKING AND USING THE SAME

(75) Inventors: William D. Joseph, Maplewood, MN (US); Gary M. Palmgren, Lake Elmo, MN (US); Stephen C. Loper, Eden Prairie, MN (US); Christopher N. Loesch, Hastings, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 359 days.

(21) Appl. No.: 13/514,741

(22) PCT Filed: Dec. 28, 2010

(86) PCT No.: PCT/US2010/062204

§ 371 (c)(1),
(2), (4) Date: Jun. 8, 2012

(87) PCT Pub. No.: WO2011/082155

PCT Pub. Date: Jul. 7, 2011

(65) Prior Publication Data

US 2012/0315830 A1 Dec. 13, 2012

Related U.S. Application Data

(60) Provisional application No. 61/291,176, filed on Dec. 30, 2009.

(51) Int. Cl.

| | |
|---|---|
| ***B24B 37/00*** | (2012.01) |
| ***B24B 37/22*** | (2012.01) |
| ***B24B 37/26*** | (2012.01) |

(52) U.S. Cl.
CPC ..... *B24B 37/22* (2013.01); *B24B 37/26* (2013.01)

(58) Field of Classification Search
CPC ..... B24B 37/22; B24B 37/26
USPC ..... 451/6, 8, 41, 59, 527–530, 539
See application file for complete search history.

(56) References Cited

U.S. PATENT DOCUMENTS

| | | | | |
|---|---|---|---|---|
| 5,257,478 | A | 11/1993 | Hyde et al. | |
| 5,578,098 | A * | 11/1996 | Gagliardi et al. | 51/295 |
| 5,609,517 | A * | 3/1997 | Lofaro | 451/529 |
| 5,921,855 | A | 7/1999 | Osterheld et al. | |
| 6,126,532 | A | 10/2000 | Sevilla et al. | |
| 6,238,592 | B1 | 5/2001 | Hardy et al. | |

(Continued)

FOREIGN PATENT DOCUMENTS

| | | | |
|---|---|---|---|
| CN | 1059219 | C | 12/2000 |
| CN | 100553883 | C | 10/2009 |

(Continued)

*Primary Examiner* — Maurina Rachuba
(74) *Attorney, Agent, or Firm* — Jeffrey S. Kollodge

(57) ABSTRACT

Polishing pads containing a phase-separated polymer blend, and methods of making and using such pads in a polishing process. In one exemplary embodiment, the polishing pads include a multiplicity of polishing elements integrally formed in a sheet. In another exemplary embodiment, the polishing elements are bonded to a support layer, for example by thermal bonding. In certain embodiments, the polishing pad may additionally include a compliant layer affixed to the support layer, and optionally, a polishing composition distribution layer.

7 Claims, 1 Drawing Sheet

(56) References Cited

U.S. PATENT DOCUMENTS

| | | | | |
|---|---|---|---|---|
| 6,491,843 | B1 | 12/2002 | Srinivasan et al. | |
| 6,641,463 | B1 | 11/2003 | Molnar | |
| 6,899,598 | B2 | 5/2005 | Prasad | |
| 6,908,366 | B2 | 6/2005 | Gagliardi | |
| 7,267,610 | B1 | 9/2007 | Elmufdi | |
| 8,821,214 | B2 * | 9/2014 | Joseph | 451/41 |
| 2003/0153245 | A1 | 8/2003 | Talieh et al. | |
| 2004/0171339 | A1 | 9/2004 | Prasad | |
| 2005/0221741 | A1 | 10/2005 | Reinhardt et al. | |
| 2006/0046622 | A1 | 3/2006 | Prasad | |
| 2006/0258276 | A1 | 11/2006 | Sung | |
| 2007/0128991 | A1 * | 6/2007 | Yoon et al. | 451/56 |
| 2008/0248734 | A1 * | 10/2008 | Bajaj | 451/527 |
| 2008/0318505 | A1 * | 12/2008 | Bajaj | 451/534 |
| 2009/0053976 | A1 * | 2/2009 | Roy et al. | 451/36 |
| 2009/0270019 | A1 * | 10/2009 | Bajaj | 451/526 |
| 2010/0203815 | A1 * | 8/2010 | Bajaj | 451/446 |
| 2011/0143539 | A1 | 6/2011 | Bajaj et al. | |
| 2011/0159786 | A1 | 6/2011 | Joseph | |
| 2011/0183583 | A1 * | 7/2011 | Joseph | 451/41 |

FOREIGN PATENT DOCUMENTS

| | | |
|---|---|---|
| EP | 0 824 995 | 2/1998 |
| EP | 0 845 328 | 6/1998 |
| EP | 1 114 697 | 7/2001 |
| EP | 1 764 189 | 3/2007 |
| JP | 2000-202764 | 7/2000 |
| JP | 2000-263423 | 9/2000 |
| JP | 2003-136397 | 5/2003 |
| JP | 2003-168667 | 6/2003 |
| JP | 2004-160573 | 6/2004 |
| JP | 2006-024885 | 1/2006 |
| JP | 2006-142439 | 6/2006 |
| WO | WO 94/04599 | 3/1994 |
| WO | 95/27595 | 10/1995 |
| WO | 02/33736 | 4/2002 |
| WO | 02/43925 | 6/2002 |
| WO | 2005/002794 | 1/2005 |
| WO | 2006/055720 | 5/2006 |
| WO | 2006/057714 | 6/2006 |
| WO | 2006/093625 | 9/2006 |
| WO | 2009/032768 | 3/2009 |
| WO | 2009-134775 | 11/2009 |
| WO | 2009/140622 | 11/2009 |
| WO | 2009/158665 | 12/2009 |
| WO | 2010/009420 | 1/2010 |

* cited by examiner

POLISHING PADS INCLUDING PHASE-SEPARATED POLYMER BLEND AND METHOD OF MAKING AND USING THE SAME

CROSS REFERENCE TO RELATED APPLICATION

This application claims the benefit of U.S. Provisional Patent Application No. 61/291,176, filed Dec. 30, 2009, the disclosure of which is incorporated by reference herein in its entirety.

TECHNICAL FIELD

The present disclosure relates to polishing pads, and to methods of making and using polishing pads in a polishing process, for example, in a chemical mechanical planarization process.

BACKGROUND

During the manufacture of semiconductor devices and integrated circuits, silicon wafers are iteratively processed through a series of deposition and etching steps to form overlying material layers and device structures. A polishing technique known as chemical mechanical planarization (CMP) may be used to remove surface irregularities (such as bumps, areas of unequal elevation, troughs, and trenches) remaining after the deposition and etching steps, with the objective of obtaining a smooth wafer surface without scratches or depressions (known as dishing), with high uniformity across the wafer surface.

In a typical CMP polishing process, a substrate such as a wafer is pressed against and relatively moved with respect to a polishing pad in the presence of a working liquid that is typically a slurry of abrasive particles in water and/or an etching chemistry. Various CMP polishing pads for use with abrasive slurries have been disclosed, for example, U.S. Pat. Nos. 5,257,478; 5,921,855; 6,126,532; 6,899,598 B2; and 7,267,610. Fixed abrasive polishing pads are also known, as exemplified by U.S. Pat. No. 6,908,366 B2, in which the abrasive particles are generally fixed to the surface of the pad, often in the form of precisely shaped abrasive composites extending from the pad surface. Recently, a polishing pad having a multiplicity of polishing elements extending from a compressible underlayer and affixed to the underlayer by a guide plate was described in PCT International Pub. No. WO 2006/057714. Although a wide variety of polishing pads are known and used, the art continues to seek new and improved polishing pads for CMP, particularly in CMP processes where larger die diameters are being used, or where higher levels of wafer surface flatness and polishing uniformity are required.

SUMMARY

In one aspect, the present disclosure describes a textured polishing pad including a first continuous polymer phase and a second discontinuous polymer phase, wherein the polishing pad has a first major side and a second major side opposite the first major side, and further wherein at least one of the first and second major sides comprises a multiplicity of grooves in the surface. In certain exemplary embodiments, the grooves have a depth of from about 1 micrometer (μm) to about 5,000 μm. In further exemplary embodiments, the polishing pad has a circular cross-section in a direction substantially normal to the first and second major sides, wherein the circular cross-section defines a radial direction, and further wherein the plurality of grooves are circular, concentric, and spaced apart in the radial direction.

In another aspect, the present disclosure describes a polishing pad including a sheet having a first major side and a second major side opposite the first major side, and a multiplicity of polishing elements extending outwardly from the first major side along a first direction substantially normal to the first major side, wherein at least a portion of the polishing elements are integrally formed with the sheet and laterally connected so as to restrict lateral movement of the polishing elements with respect to one or more of the other polishing elements, but remaining moveable in an axis substantially normal to a polishing surface of the polishing elements, wherein at least a portion of the plurality of polishing elements comprise a first continuous polymer phase and a second discontinuous polymer phase. In some exemplary embodiments, the polishing pad further includes a polishing composition distribution layer covering at least a portion of the first major side.

In a further aspect, the present disclosure describes a polishing pad including a support layer having a first major side and a second major side opposite the first major side, and a multiplicity of polishing elements bonded to the first major side of the support layer, wherein each polishing element has an exposed polishing surface, and wherein the polishing elements extend from the first major side of the support layer along a first direction substantially normal to the first major side, further wherein at least a portion of the plurality of polishing elements comprise a first continuous polymer phase and a second discontinuous polymer phase. In some exemplary embodiments, each polishing element is affixed to the first major side by bonding to the support layer, preferably using direct thermal bonding or an adhesive.

In additional exemplary embodiments of polishing pads including polishing elements as described above, at least one of the polishing elements is a porous polishing element, wherein each porous polishing element includes a multiplicity of pores. In certain exemplary embodiments, substantially all of the polishing elements are porous polishing elements. In some particular exemplary embodiments, the pores are distributed throughout substantially the entire porous polishing element. In certain presently preferred embodiments of polishing pads with polishing elements, at least one of the polishing elements is a transparent polishing element.

In further exemplary embodiments of polishing pads including polishing elements as described above, the polishing elements further comprise abrasive particulates having a median diameter of less than one micrometer. In other exemplary embodiments, at least a portion of the polishing elements are substantially free of abrasive particulates. In additional exemplary embodiments, the polishing pad is substantially free of abrasive particulates.

In other exemplary embodiments of any of the polishing pads as described above, the polishing pad includes a compliant layer affixed to the second major side. In further exemplary embodiments of polishing pads as described above, the polishing pad includes a pressure sensitive adhesive layer affixed to the compliant layer opposite the second major side.

In yet another aspect, the present disclosure describes a method of using a polishing pad as described above, the method including contacting a surface of a substrate with a polishing surface of the polishing pad, and relatively moving the polishing pad with respect to the substrate to abrade the surface of the substrate. In some exemplary embodiments, the method further includes providing a polishing composition to an interface between the polishing pad surface and the substrate surface.

In a further aspect, the present disclosure describes a method of making a polishing pad as described above, the method including mixing a first polymer with a second polymer with application of heat to form a fluid molding composition, dispensing the fluid molding composition into a mold, cooling the fluid molding composition to form a polishing pad including a first continuous polymer phase comprising the first polymer, and a second discontinuous polymer phase comprising the second polymer, wherein the polishing pad has a first major surface and a second major surface opposite the first major surface.

In some exemplary embodiments, dispersing the first polymer in the second polymer comprises melt mixing, kneading, extrusion, or combinations thereof. In certain exemplary embodiments, dispensing the fluid molding composition into the mold comprises at least one of reaction injection molding, extrusion molding, compression molding, vacuum molding, or a combination thereof. In some particular exemplary embodiments, dispensing comprises continuously extruding the fluid molding composition through a film die onto a casting roller, further wherein the surface of the casting roller comprises the mold.

In additional exemplary embodiments, the method further includes milling at least one of the first and second major surfaces to form a multiplicity of grooves in the surface. In certain exemplary embodiments, the grooves have a depth of from about 1 μm to about 5,000 μm. In some particular exemplary embodiments, the polishing pad has a circular cross-section in a direction substantially normal to the first and second surfaces, wherein the circle defines a radial direction, and further wherein the plurality of grooves are circular, concentric, and spaced in the radial direction.

In further exemplary embodiments, the mold includes comprises a three-dimensional pattern, and the first major surface comprises a multiplicity of polishing elements corresponding to an impression of the three-dimensional pattern, wherein the plurality of polishing elements extend outwardly from the first major side along a first direction substantially normal to the first major side, further wherein the polishing elements are integrally formed with the sheet and laterally connected so as to restrict lateral movement of the polishing elements with respect to one or more of the other polishing elements, but remaining moveable in an axis substantially normal to a polishing surface of the polishing elements.

In an additional aspect, the present disclosure describes a method of making a polishing pad as described above, the method including forming a multiplicity of polishing elements including a first continuous polymer phase comprising a first polymer and a second discontinuous polymer phase comprising a second polymer, and bonding the polishing elements to a first major side of a support layer having a second major side opposite the first major side to form a polishing pad. In some exemplary embodiments, the method further includes affixing a compliant layer to the second major side. In further exemplary embodiments, the method further includes affixing a polishing composition distribution layer covering at least a portion of the first major side.

In some exemplary embodiments, the method additionally includes forming a pattern with the polishing elements on the first major side. In certain exemplary embodiments, forming a pattern comprises reaction injection molding the polishing elements in the pattern, extrusion molding the polishing elements in the pattern, compression molding the polishing elements in the pattern, arranging the polishing elements within a template corresponding to the pattern, or arranging the polishing elements on the support layer in the pattern. In some particular exemplary embodiments, bonding the polishing elements to the support layer comprises thermal bonding, ultrasonic bonding, actinic radiation bonding, adhesive bonding, and combinations thereof.

In certain presently preferred exemplary embodiments, at least a portion of the polishing elements comprise porous polishing elements. In some exemplary embodiments, at least some of the polishing elements comprise substantially non-porous polishing elements. In some particular exemplary embodiments, the porous polishing elements are formed by injection molding of a gas saturated polymer melt, injection molding of a reactive mixture that evolves a gas upon reaction to form a polymer, injection molding of a mixture comprising a polymer dissolved in a supercritical gas, injection molding of a mixture of incompatible polymers in a solvent, injection molding of porous thermoset particulates dispersed in a thermoplastic polymer, injection molding of a mixture comprising microballoons, and combinations thereof. In additional exemplary embodiments, the pores are formed by reaction injection molding, gas dispersion foaming, and combinations thereof.

Exemplary embodiments of polishing pads according to the present disclosure have various features and characteristics that enable their use in a variety of polishing applications. In some presently preferred embodiments, polishing pads of the present disclosure may be particularly well suited for chemical mechanical planarization (CMP) of wafers used in manufacturing integrated circuits and semiconductor devices. In certain exemplary embodiments, the polishing pad described in this disclosure may provide some or all of the following advantages.

For example, in some exemplary embodiments, a polishing pad according to the present disclosure may act to better retain a working liquid used in the CMP process at the interface between the polishing surface of the pad and the substrate surface being polished, thereby improving the effectiveness of the working liquid in augmenting polishing. In other exemplary embodiments, a polishing pad according to the present disclosure may reduce or eliminate dishing and/or edge erosion of the wafer surface during polishing.

In further exemplary embodiments, use of a polishing pad with porous elements according to the present disclosure may permit processing of larger diameter wafers while maintaining the required degree of surface uniformity to obtain high chip yield, processing of more wafers before conditioning of the pad surface is needed in order to maintain polishing uniformity of the wafer surfaces, or reducing process time and wear on the pad conditioner. In certain embodiments, CMP pads with porous polishing elements may also offer the benefits and advantages of conventional CMP pads having surface textures such as grooves, but may be manufactured more reproducibly at a lower cost. In additional embodiments, bonding of the polishing elements to the support layer may eliminate the need to use a guide plate or an adhesive to affix the elements to the support layer.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain preferred embodiments using the principles disclosed herein.

BRIEF DESCRIPTION OF DRAWINGS

Exemplary embodiments of the present disclosure are further described with reference to the appended figures, wherein.

Like reference numerals in the drawings indicate like elements. The drawings herein are not drawn to scale, and in the drawings the components of the polishing pads are sized to emphasize selected features.

DETAILED DESCRIPTION

In a typical CMP slurry process for wafer polishing, a wafer possessing a characteristic topography is put in contact with a polishing pad and a polishing solution containing an abrasive and a polishing chemistry. If the polishing pad is compliant, the phenomenon of dishing and erosion may occur due to the soft pad polishing the low areas on the wafer at the same rate as the raised areas. If the polishing pad is rigid, dishing and erosion may be greatly reduced; however, even though rigid polishing pads may advantageously yield good within die planarization uniformity, they may also disadvantageously yield poor within wafer uniformity, due to a rebound effect which occurs on the wafer perimeter. This rebound effect results in poor edge yield and a narrow CMP polishing process window. In addition, it may be difficult to develop a stable polishing process with a rigid polishing pad, because such pads are sensitive to different wafer topographies, and are completely dependent upon use of a pad conditioner to create an optimal polishing texture which holds the polishing solution and interfaces with the wafer.

Thus, in some exemplary embodiments, the present disclosure is directed to improved CMP polishing pads which, in various embodiments, combine some of the advantageous characteristics of both compliant and rigid polishing pads, while eliminating or reducing some of the disadvantageous characteristics of the respective pads.

Various exemplary embodiments of the disclosure will now be described with particular reference to the Drawings. Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the limitations set forth in the claims and any equivalents thereof.

Figure 1:
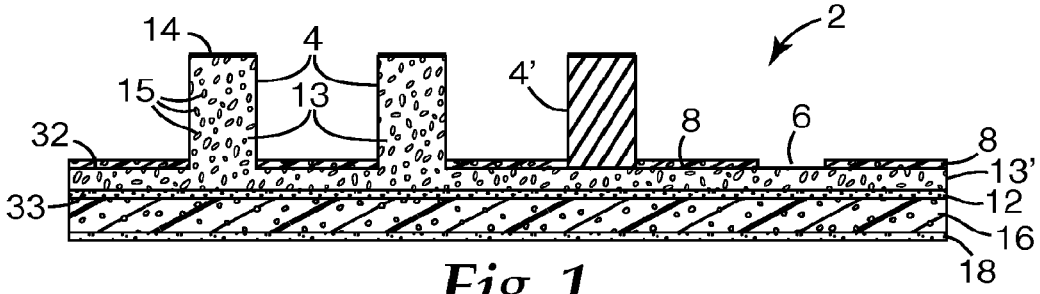
FIG. 1 is a cross-sectional side view of a polishing pad including a sheet of integrally formed polishing elements according to one exemplary embodiment of the present disclosure.

Referring to FIG. 1, in one exemplary embodiment the present disclosure provides a polishing pad 2 comprising a sheet 13' having a first major side 32 and a second major side 33 opposite the first major side 32, and a plurality of polishing elements 4 extending outwardly from the first major side 32 along a first direction substantially normal to the first major side 32 as shown in FIG. 1, wherein at least a portion of the polishing elements 4 are integrally formed with the sheet 13' and laterally connected so as to restrict lateral movement of the polishing elements 4 with respect to one or more of the other polishing elements 4, but remaining moveable in an axis substantially normal to a polishing surface 14 of the polishing elements 4, wherein at least a portion of the plurality of polishing elements 4 comprise a first continuous polymer phase 13 and a second discontinuous polymer phase 15.

In the particular exemplary embodiment illustrated by FIG. 1, sheet 13' is affixed to an optional compliant layer 16 positioned on a side opposite the plurality of polishing elements 4 (i.e. on second major side 33). Furthermore, an optional adhesive layer 12 is shown at an interface between compliant layer 16 and the sheet 13'. Optional adhesive layer 12 may be used to affix the second major side 33 of the sheet 13' to the compliant layer 16. Additionally, an optional pressure sensitive adhesive layer 18, affixed to the compliant layer 16 opposite the plurality of polishing elements 4, may be used to temporarily (e.g. removably) secure the polishing pad 2 to a polishing platen (not shown in FIG. 1) of a CMP polishing apparatus (not shown in FIG. 1).

In some exemplary embodiments, the polishing pad 2 further includes an optional polishing composition distribution layer 8 covering at least a portion of the first major side, as shown in FIG. 1. During a polishing process, the optional polishing composition distribution layer 8 aids distribution of the working liquid and/or polishing slurry to the individual polishing elements 4. A plurality of apertures 6 are provided extending through the polishing composition distribution layer 8. A portion of each polishing element 4 extends into a corresponding aperture 6.

Figure 2:
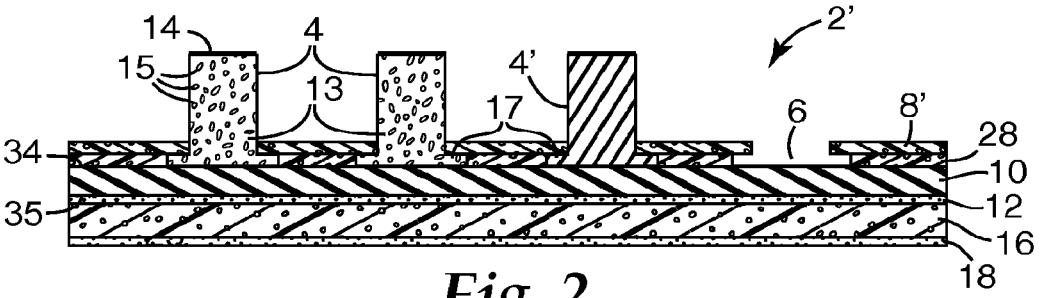
FIG. 2 is a cross-sectional side view of a polishing pad including a plurality of polishing elements bonded to a support layer according to another exemplary embodiment of the present disclosure.

In an alternate embodiment shown in FIG. 2, the present disclosure provides a polishing pad 2' including a support layer 10 having a first major side 34 and a second major side 35 opposite the first major side 34, and a plurality of polishing elements 4 bonded to the first major side 34 of the support layer 10, wherein each polishing element 4 has an exposed polishing surface 14, and wherein the polishing 4 elements extend from the first major side 34 of the support layer 10 along a first direction substantially normal to the first major side 34, further wherein at least a portion of the plurality of polishing elements 4 comprise a first continuous polymer phase 13 and a second discontinuous polymer phase.

In some exemplary embodiments of a polishing pad 2', each polishing element 4 is affixed to the first major side 34 by direct thermal bonding to the support layer 10, or by using an adhesive (not shown in FIG. 2) to bond the polishing elements 4 to the support layer 10. In certain exemplary embodiments, the polishing pad further includes an optional guide plate 28 opposite the support layer 10 on the first major side 34, wherein the guide plate 28 comprises a plurality of apertures 6 extending through the guide plate 28, and further wherein at least a portion of each polishing element 4 extends into a corresponding aperture 6. In certain exemplary embodiments, a portion of each polishing element 4 passes through the corresponding aperture 6. In some particular exemplary embodiments, each polishing element has a flange 17, and each flange 17 has a perimeter greater than the perimeter of the corresponding aperture 6, as shown in FIG. 2.

In the particular exemplary embodiment illustrated by FIG. 2, support layer 10 is affixed to an optional compliant layer 16 positioned on the second major side 35 of the support layer 10 opposite the plurality of polishing elements 4 affixed to the first major side 34 of the support layer 10. Furthermore, an optional adhesive layer 12 is shown at an interface between compliant layer 16 and the support layer 10. Optional adhesive layer 12 may be used to affix the second major side 35 of the support layer 10 to the compliant layer 16. Additionally, an optional pressure sensitive adhesive layer 18, affixed to the compliant layer 16 opposite the plurality of polishing elements 4, may be used to temporarily (e.g. removably) secure the polishing pad 2' to a polishing platen (not shown in FIG. 2) of a CMP polishing apparatus (not shown in FIG. 2).

An optional guide plate 28 is also shown in the exemplary embodiment of FIG. 2. The optional guide plate 28, which may also serve as an alignment template for arranging the plurality of polishing elements 4 on the first major side of support layer 10, is not generally required in order to produce polishing pads 2' according to the present disclosure. In certain exemplary embodiments, the optional guide plate 28 may be entirely eliminated from the polishing pad, as illustrated by polishing pad 2 of FIG. 1. Such embodiments may advantageously be easier and less expensive to fabricate than other known polishing pads comprising a multiplicity of polishing elements.

An optional polishing composition distribution layer 8', which may also serve as a guide plate for the polishing elements 4, is additionally shown in FIG. 2. During a polishing process, the optional polishing composition distribution layer 8' aids distribution of the working liquid and/or polishing slurry to the individual polishing elements 4. When used as a guide plate, the polishing composition distribution layer 8' may be positioned on the first major side 34 of the support layer 10 to facilitate arrangement of the plurality of polishing elements 4, such that a first major surface of the polishing composition distribution layer 8' is distal from the support layer 10, and a second major surface of the polishing composition distribution layer 8' opposite the first major surface of the polishing composition distribution layer 8' is proximate the support layer 10, as shown in FIG. 2. A plurality of apertures 6 may also be provided extending through at least the optional guide plate 28 (if present) and/or the optional polishing composition distribution layer 8' (if present), as shown in FIG. 2.

As illustrated by FIG. 2, each polishing element 4 extends from the first major surface of the optional guide plate 28 along a first direction substantially normal to the first major side of support layer 10. In some embodiments shown in FIG. 2, each polishing element 4 has a mounting flange 17, and each polishing element 4-4' is bonded to the first major side of the support layer 10 by engagement of the corresponding flange 17 to the first major side 34 of the support layer 10, and optionally, the second major surface of optional polishing composition distribution layer 8' or the optional guide plate 28. Consequently, during a polishing process, the polishing elements 4 are free to independently undergo displacement in a direction substantially normal to the first major side 34 of support layer 10, while still remaining bonded to the support layer 10, and optionally additionally affixed to the support layer 10 by the optional polishing composition distribution layer 8' and/or optional guide plate 28.

In such embodiments, preferably at least a portion of each polishing element 4 extends into a corresponding aperture 6, and more preferably, each polishing element 4 also passes through the corresponding aperture 6 and extends outwardly from the first major surface of the optional guide plate 28. Thus, the plurality of apertures 6 of optional guide plate 28 and/or optional polishing composition distribution layer 8', may also serve as a template to guide the lateral arrangement of polishing elements 4 on the first major side 34 of support layer 10. In other words, optional guide plate 28 and/or optional polishing composition distribution layer 8' may be used as a template or guide to arrange the plurality of polishing elements 4 on the first major side 34 of support layer 10 during the polishing pad fabrication process.

In the particular embodiment illustrated by FIG. 2, the optional guide plate 28 may comprise an adhesive (not shown) positioned at the interface between the support layer 10 and the polishing composition distribution layer 8'. The optional guide plate 28 may thus be used to adhere the optional polishing composition distribution layer 8' to the support layer 10, thereby securely affixing the plurality of polishing elements 4 to the first major side 34 of support layer 10. However, other bonding methods may be used, including direct thermal bonding of the polishing elements 4 to the support layer 10 using, for example, heat and pressure.

In a related exemplary embodiment of the polishing pad 2' of FIG. 2, the plurality of apertures may be arranged as an array of apertures, wherein at least a portion of the apertures 6 comprise a main bore formed by optional polishing composition distribution layer 8', and an undercut region formed by optional guide plate 28, and the undercut region forms a shoulder that engages with the corresponding polishing element flange 17, thereby securely affixing polishing elements 4 to support layer 10 without requiring direct bonding of the polishing elements 4 to support layer 10. In addition, in some exemplary embodiments not illustrated by FIG. 2, the multiplicity of polishing elements 4 may be arranged in a pattern, for example, as a two-dimensional array of elements arranged on a major surface of the support layer 10, or in a template or jig used to arrange the polishing elements 4 before bonding to the support layer 10.

In any of the embodiments of polishing pads 2-2' illustrated in FIGS. 1-2, at least a portion of the polishing elements 4 may be porous polishing elements, and some portion of the polishing elements 4' may be substantially nonporous polishing elements. It will be understood, however, that in other exemplary embodiments, all of the polishing elements 4 may be selected to be porous polishing elements, or all of the polishing elements may be selected to be substantially nonporous polishing elements 4'. In some exemplary embodiments, at least one of the polishing elements is a porous polishing element, wherein each porous polishing element includes a plurality of pores. In certain exemplary embodiments, substantially all of the polishing elements are porous polishing elements. In some particular exemplary embodiments, the pores are distributed throughout substantially the entire porous polishing element.

Suitable porous polishing elements are disclosed in PCT International Pub. No. WO 2009/158665.

In certain presently preferred embodiments, the plurality of pores is created by at least partially removing at least a portion of the second discontinuous polymer phase 15 from at least a portion of the polishing elements 4 of polishing pad 2-2', thereby leaving a void or pore volume corresponding to the volume previously occupied by the second discontinuous polymer phase 15. In some exemplary embodiments, the second discontinuous polymer phase may be soluble in a solvent in which the first continuous polymer phase 13 is substantially insoluble or only partially soluble.

In some exemplary embodiments, the second discontinuous polymer phase comprises a water soluble, water swellable or hydrophilic polymer, and water or an aqueous solvent is used to dissolve and thereby remove at least a portion of the second discontinuous polymer phase 15 from one or more polishing elements 4, thereby creating one or more porous polishing elements. In certain exemplary embodiments, the aqueous solvent is selected to be the working liquid used in a chemical mechanical polishing process, and this working liquid is used to dissolve and thereby remove at least a portion of the second discontinuous polymer phase 15 from one or more polishing elements 4, thereby creating one or more porous polishing elements.

In the particular embodiment illustrated by FIGS. 1-2, two porous polishing elements 4 are shown along with one substantially nonporous polishing element 4'. However, it will be understood that any number of polishing elements 4 may be used, and that any number of polishing elements 4 may be selected to be porous polishing elements 4 or substantially nonporous polishing elements 4'.

In some presently preferred embodiments, at least a portion of the polishing elements 4 are porous polishing elements, which in certain embodiments at least have a porous polishing surface (14 in FIGS. 1-2), which may make sliding or rotational contact with a substrate (not shown in FIG. 1) to be polished. Referring again to FIGS. 1-2, the polishing surface 14 of polishing elements 4 may be a substantially flat surface, or may be textured. In certain presently preferred embodiments, at least the polishing surface of each polishing element 4 is made porous, for example with microscopic surface openings or pores 15, which may take the form of orifices, passageways, grooves, channels, and the like. Such pores 15 at the polishing surface may act to facilitate distributing and maintaining a polishing composition (e.g., a working liquid and/or abrasive polishing slurry not shown in the figures) at the interface between a substrate (not shown) and the corresponding porous polishing elements.

In certain exemplary embodiments, the polishing surface 14 comprises pores 15 that are generally cylindrical capillaries. The pores 15 may extend from the polishing surface 14 into the polishing element 4. In a related embodiment, the polishing surface comprises pores 15 that are generally cylindrical capillaries extending from the polishing surface 14 into the porous polishing element 4. The pores need not be cylindrical, and other pore geometries are possible, for example, conical, rectangular, pyramidal, and the like. The characteristic dimensions of the pores can, in general, be specified as a depth, along with a width (or diameter), and a length. The characteristic pore dimensions may range from about 25 μm to about 6,500 μm in depth, from about 5 μm to about 1000 μm in width (or diameter), and from about 10 μm to about 2,000 μm in length.

In some exemplary embodiments, the porous polishing elements may not have a porous polishing surface 14, but in these and other exemplary embodiments, pores 15 may be distributed throughout substantially the entire porous polishing element 4. Such porous polishing elements may be useful as compliant polishing elements exhibiting some of the advantageous characteristics of a compliant polishing pad. In certain presently preferred embodiments, the polishing elements 4 may comprise a plurality of pores distributed throughout substantially the entire polishing element 4 in the form of a porous foam. The foam may be a closed cell foam, or an open cell foam. Closed cell foams may be preferred in some embodiments. Preferably, the plurality of pores 15 in the foam exhibits a unimodal distribution of pore size, for example, pore diameter.

In some particular exemplary embodiments, the plurality of pores exhibits a mean pore size of at least about 1 nanometer (nm), at least about 100 nm, at least about 500 nm, or at least about 1 μm. In other exemplary embodiments, the plurality of pores exhibits a mean pore size of at most about 300 μm, at most about 100 μm, at most about 50 μm, at most about 10 μm, or at most about 1 μm. In certain presently preferred embodiments, the plurality of pores exhibits a mean pore size from about 1 nm to about 300 μm, about 0.5 μm to about 100 μm, about 1 μm to about 100 μm, or about 2 μm to about 50 μm.

In additional exemplary embodiments of polishing pads 2-2' including substantially nonporous polishing elements 4' as described above, at least one of the nonporous polishing elements 4' is preferably a transparent polishing element. In some exemplary embodiments, the sheet 13' or support layer 10, the optional guide plate 28, the optional polishing composition distribution layer 8-8', the optional compliant layer 16, the optional adhesive 12, layer, at least one substantially nonporous polishing elements 4', or a combination thereof is transparent. In certain exemplary embodiments illustrated in FIG. 1, at least one transparent nonporous polishing element 4' is affixed to a transparent portion of the first major side 32 of sheet 13', e.g. using direct thermal bonding or with an adhesive (not shown in FIG. 1).

Furthermore, it will be understood that the polishing pads 2-2' need not comprise only substantially identical polishing elements 4. Thus, for example, any combination or arrangement of porous polishing elements and non-porous polishing elements may make up the plurality of polishing elements 4. It will also be understood that any number, combination or arrangement of porous polishing elements and substantially nonporous polishing elements 4' may be used advantageously in certain embodiments to form a polishing pad having a plurality of polishing elements 4.

In some exemplary embodiments, the polishing elements (4-4' in FIGS. 1-2) may be distributed on the first major side of sheet 13' (FIG. 1) or support layer 10 (FIG. 2) in a wide variety of patterns, depending on the intended application, and the patterns may be regular or irregular. Thus, in some exemplary embodiments of a polishing pad 2-2', the plurality of polishing elements 4 may be arranged in a pre-determined regular pattern, for example, on a major surface of the support layer 10, or in a template or jig (not shown in the FIGs.) used to arrange the polishing elements before bonding to the support layer 10. After arranging the plurality of polishing elements 4 in the pattern using the template or jig, the first major side 34 of the support layer 10 may be contacted with and bonded to the plurality of polishing elements 4, for example, by direct thermal bonding to the support layer 10, or by using an adhesive, or other bonding material.

The polishing elements may reside on substantially the entire surface of the sheet 13' or support layer 10, or there may be regions of the sheet 13' or support layer 10 that include no polishing elements. In some embodiments, the polishing elements have an average surface coverage of the support layer of at least 30%, at least 40%, or at least 50%. In further embodiments, the polishing elements have an average surface coverage of the support layer of at most about 80%, at most about 70%, or at most about 60% of the total area of the major surface of the support layer, as determined by the number of polishing elements, the cross-sectional area of each polishing element, and the cross-sectional area of the polishing pad.

Figure 3A:
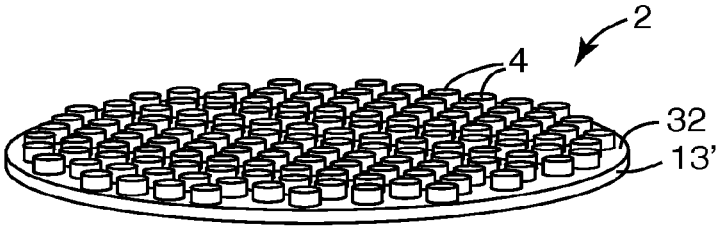
FIG. 3A is a perspective view of a polishing pad with polishing elements arranged in a pattern according to an exemplary embodiment of the present disclosure.
Figure 3B:
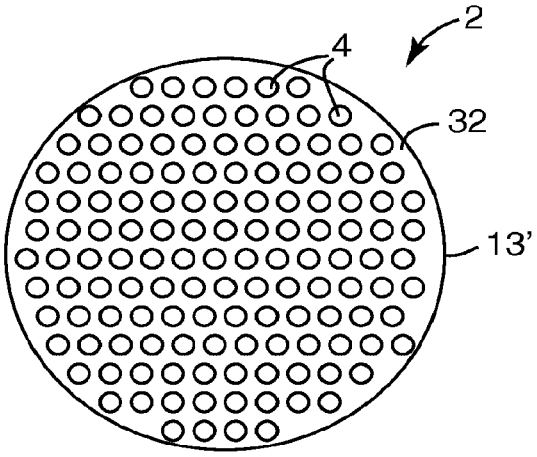
FIG. 3B is a top view of a polishing pad with polishing elements arranged in a pattern according to another exemplary embodiment of the present disclosure.

In an exemplary embodiment of a presently preferred polishing pad 2 illustrated by FIG. 3A-3B, the polishing elements 4 are integrally formed with sheet 13' and arranged in a two-dimensional array pattern on the first major side 32 of sheet 13'. It will be understood that any of the optional layers (e.g. the optional polishing composition distribution layer 8, the optional adhesive 12, the optional compliant layer 16, the optional pressure sensitive adhesive layer 18, and the at least one substantially nonporous/transparent polishing element 4') as described above as suitable for use in a polishing pad 2 may be combined to form the polishing pad shown in FIG. 3A-3B.

FIG. 3A illustrates one particular shape of a polishing element 4. It will be understood that the polishing elements 4 may be formed in virtually any shape, and that a plurality of polishing elements 4 having two or more different shapes may be advantageously used and optionally arranged in a pattern to form a polishing pad 2-2' as described above. It will be further understood that the same shape or a different shape may be used to produce a porous polishing element or alternatively, a substantially nonporous polishing element.

In some exemplary embodiments, the cross-sectional shape of the polishing elements 4, taken through a polishing element 4 in a direction generally parallel to the polishing surface 14, may vary widely depending on the intended application. Although FIG. 3A shows a generally cylindrical polishing element 4 having a generally circular cross section, other cross-sectional shapes are possible and may be desirable in certain embodiments. Thus, in further exemplary embodiments of polishing pads 2-2' including polishing elements 4-4' as previously described, the polishing elements are selected to have a cross-section, taken in the first direction, selected from circular, elliptical, triangular, square, rectangular, and trapezoidal, and combinations thereof.

For generally cylindrical polishing elements 4 having a circular cross section as shown in FIGS. 3A-3B, the cross-sectional diameter of the polishing element 4 in a direction generally parallel to the polishing surface 14 is, in some embodiments, at least about 50 μm, more preferably at least about 1 mm, still more preferably at least about 5 mm. In certain embodiments, the cross-sectional diameter of the polishing element 4 in a direction generally parallel to the polishing surface 14 is at most about 20 mm, more preferably at most about 15 mm, still more preferably at most about 12 mm. In some embodiments, the diameter of the polishing element, taken at the polishing surface 14, may be from about 50 μm to about 20 mm, in certain embodiments the diameter is from about 1 mm to about 15 mm, and in other embodiments the cross-sectional diameter is from about 5 mm to about 12 mm.

In additional exemplary embodiments of polishing pads 2-2', the polishing elements 4 may be characterized by a characteristic dimension in terms of a height, width, and/or length. In certain exemplary embodiments, the characteristic dimension may be selected to be at least about 50 μm, more preferably at least about 1 mm, still more preferably at least about 5 mm. In certain embodiments, the cross-sectional diameter of the polishing element 4 in a direction generally parallel to the polishing surface 14 is at most about 20 mm, more preferably at most about 15 mm, still more preferably at most about 12 mm. In additional exemplary embodiments, the polishing elements are characterized by at least one of a height from 250 to 2,500 μm, a width 1 mm to 50 mm, a length from 5 mm to 50 mm, or a diameter of from 1 mm to 50 mm. In certain exemplary embodiments, one or more of the polishing elements 4-4' may be hollow.

In other exemplary embodiments, the cross-sectional area of each polishing element 4 in a direction generally parallel to the polishing surface 14, may be at least about 1 $mm^2$, in other embodiments at least about 10 $mm^2$, and in still other embodiments at least about or 20 $mm^2$. In other exemplary embodiments, the cross-sectional area of each polishing element 4 in a direction generally parallel to the polishing surface 14, may be at most about 1,000 $mm^2$, in other embodiments at most about 500 $mm^2$, and in still other embodiments at most about 250 $mm^2$.

The cross-sectional area of the polishing pad in a direction generally parallel to a major surface of the polishing pad may, in some exemplary embodiments, range from about 100 $cm^2$ to about 300,000 $cm^2$, in other embodiments from about 1,000 $cm^2$ to about 100,000 $cm^2$, and in yet other embodiments, from about 2,000 $cm^2$ to about 50,000 $cm^2$.

Prior to the first use of the polishing pad (2 in FIG. 1, 2' in FIG. 2) in a polishing operation, in some exemplary embodiments, each polishing element (4-4' in FIGS. 1-2) extends along the first direction substantially normal to the first major side of the support layer (10 in FIGS. 1-2). In certain exemplary embodiments, the polishing elements extend along the first direction at least about 0 mm, at least about 0.1 mm, at least about 0.25 mm, at least about 0.3 mm, or at least about 0.5 mm above a plane including the optional polishing composition distribution layer (8 in FIG. 1, 8' in FIG. 2) and/or optional guide plate (28 in FIG. 2). In other exemplary embodiments, the polishing elements extend along the first direction at most about 10 mm, at most about 7.5 mm, at most about 5 mm, at most about 3 mm, at most about 2 mm, or at most about 1 mm above a plane including the optional polishing composition distribution layer (8 in FIG. 1, 8' in FIG. 2) and/or optional guide plate (28 in FIG. 2).

In other exemplary embodiments (not shown in the FIGs.), the polishing surfaces of the polishing elements may be made flush with the exposed major surface of the optional polishing composition distribution layer. In other exemplary embodiments, the polishing surfaces of the polishing elements may be made recessed below the exposed major surface of the optional polishing composition distribution layer, and subsequently made flush with, or made to extend beyond, the exposed major surface of the optional polishing composition distribution layer, for example, by removal of a portion of the optional polishing composition distribution layer. Such embodiments may be advantageously used with polishing composition distribution layers that are selected to be abraded or eroded during the polishing process or in optional conditioning processes applied to the polishing pad before, during, or after contact with a workpiece.

In further exemplary embodiments, each polishing element 4-4' extends along the first direction at least about 0.25 mm, at least about 0.3 mm, or at least about 0.5 mm above a plane including the sheet 13' (FIG. 1) or support layer 10 (FIG. 2). In additional exemplary embodiments, the height of the polishing surface (14 in FIGS. 1-2) above the base or bottom of the polishing element, that is, the height (H) of the polishing element may be 0.25 mm, 0.5 mm, 1.0 mm, 1.5 mm, 2.0 mm, 2.5 mm, 3.0 mm, 5.0 mm, 10 mm or more, depending on the polishing composition used and the material selected for the polishing elements.

Referring again to FIGS. 1-2, the depth and spacing of the apertures (6 in FIG. 1-2) throughout the optional polishing composition distribution layer (8 in FIG. 1, 8' in FIG. 2) and/or optional guide plate 28 (FIG. 2) may be varied as necessary for a specific CMP process. In some embodiments, the polishing elements (4-4' in FIGS. 1-2) are each maintained substantially in planar orientation with respect to one other and the polishing composition distribution layer (8 in FIG. 1, 28 in FIG. 2) and guide plate 31, and project above the surface of the optional polishing composition distribution layer (8 in FIG. 1, 8' in FIG. 2) and/or optional guide plate 28.

In some exemplary embodiments, the void volume created by the extension of the polishing elements 4 above any optional guide plate (28 in FIG. 2) and any optional polishing composition distribution layer (8 in FIG. 1, 8' in FIG. 2) may provide room for distribution of a polishing composition on the surface of the optional polishing composition distribution layer (8 in FIG. 1, 8' in FIG. 2). The polishing elements 4 protrude above the polishing composition distribution layer (8 in FIG. 1, 8' in FIG. 2) by an amount that depends at least in part on the material characteristics of the polishing elements and the desired flow of polishing composition (working liquid and or abrasive slurry) over the surface of the polishing composition distribution layer (8 in FIG. 1, 8' in FIG. 2).

In another alternative exemplary embodiment (not illustrated in the FIGs.), the present disclosure provides a textured polishing pad including a first continuous polymer phase and a second discontinuous polymer phase, wherein the polishing pad has a first major side and a second major side opposite the first major side, and further wherein at least one of the first and second major sides comprises a multiplicity of grooves extending into the side. In some exemplary embodiments, the depth of each groove in a direction substantially normal to the polishing surface of the polishing elements is selected to be in the range of at least about 10 μm, 25 μm, 50 μm, 100 μm; to about 10,000 μm, 7,500 μm, 5,000 μm, 2,500 μm, 1,000 μm. about 1 micrometer (μm) to about 5,000 μm. In further exemplary embodiments, the polishing pad has a circular cross-section in a direction substantially normal to the first and second sides, wherein the circle defines a radial direction, and further wherein the plurality of grooves are circular, concentric, and spaced apart in the radial direction.

In other exemplary embodiments (not illustrated in the FIGs.), the polishing surface of the textured polishing pad comprises pores in the form of a plurality of channels, wherein each channel extends across at least a portion of the polishing surface, preferably in a direction generally parallel to the polishing surface. Preferably, each channel is a circular channel that extends radially around a circumference of the polishing surface in a direction generally parallel to the polishing surface. In other embodiments, the plurality of channels form a series of radially spaced concentric circular grooves in the polishing surface. In other exemplary embodiments (not illustrated), the pores may take the form of a two-dimensional array of channels in which each channel extends across only a portion of the polishing surface.

In further exemplary embodiments (not illustrated in the FIGs.), the channels may have virtually any shape, for example, cylindrical, triangular, rectangular, trapezoidal, hemispherical, and combinations thereof. In some exemplary embodiments, the depth of each channel in a direction substantially normal to the polishing surface of the polishing elements is selected to be in the range of at least about 10 μm, 25 μm, 50 μm, 100 μm; to about 10,000 μm, 7,500 μm, 5,000 μm, 2,500 μm, 1,000 μm. In other exemplary embodiments, the cross-sectional area of each channel in a direction substantially parallel to the polishing surface of the polishing elements is selected to be in the range from about 75 square micrometers ($\mu m^2$) to about $3\times10^6$ $\mu m^2$.

In any of the exemplary embodiments of polishing pads 2-2' with polishing elements 4 as described above, the polishing elements 4 may comprise a wide variety of materials, with polymeric materials being preferred. Suitable polymeric materials include, for example, polyurethanes, polyacrylates, polyvinyl alcohol, poly(ethylene oxide), poly(vinyl alcohol), poly(vinyl pyrollidone), polyacrylic acid, poly(meth)acrylic acid, polycarbonates, and poly(acetals) available under the trade designation DELRIN (available from E.I. DuPont de Nemours, Inc., Wilmington, Del.). In some exemplary embodiments, at least some of the polishing elements comprise a thermoplastic polyurethane, a polyacrylate, polyvinyl alcohol, or combinations thereof.

The polishing elements may also comprise a reinforced polymer or other composite material, including, for example, metal particulates, ceramic particulates, polymeric particulates, fibers, combinations thereof, and the like. In certain embodiments, polishing elements may be made electrically and/or thermally conductive by including therein fillers such as, carbon, graphite, metals or combinations thereof. In other embodiments, electrically conductive polymers such as, for example, polyanilines (PANI) sold under the trade designation ORMECOM (available from Ormecon Chemie, Ammersbek, Germany) may be used, with or without the electrically or thermally conductive fillers referenced above.

In any of the exemplary embodiments of polishing pads as described above, the polishing surface is formed by a phase separated polymer blend comprising a first continuous polymer phase and a second discontinuous polymer phase immiscible in the first continuous polymer phase at room temperature. While not wishing to be bound by any particular theory, Applicant presently believes that the polymer blends are miscible at an elevated processing temperature (e.g. at or above the softening or melt temperature of at least the polymer forming the first continuous polymer phase), thereby forming fluid, binary solutions of polymers or a complex solution containing multiple polymer types.

Upon cooling below the elevated processing temperature (e.g. below the crystallization temperature of at least the polymer forming the second discontinuous polymer phase), the polymers phase separate into a first continuous polymer phase and a second discontinuous dispersed polymer phase, depending on the thermodynamics and volume ratio of each polymer used in the mixture. The size of the dispersed phase domains can be controlled by the loading of the dispersed phase, the polymer properties of both phases and the thermal/mechanical environment which the polymer blend experiences during processing.

Polymeric films generated from these type of immiscible blend systems characteristically shed the dispersed (i.e. discontinuous) polymer phase when subjected to fracture or scoring. Therefore if a pad surface is generated from this type of polymeric blend, the surface would be characterized has having porosity resulting from the shedding or release of the dispersed polymer phase.

The composition of the polymer blend is preferably selected to include at least two different polymer types, although multiple polymer types may be used in each phase. Preferably, the polymeric blend comprises at least one polymer type generally characterized as a thermoplastic elastomer as a major component in the first continuous phase, and at least one polymer type generally characterized as a soft thermoplastic polymer in the second discontinuous phase.

In any of the exemplary embodiments of polishing pads as described above, the first continuous polymer phase preferably comprises a thermoplastic elastomer selected from a polyurethane, a polyolefin elastomer, a fluoroelastomer, a silicone elastomer, synthetic rubber, natural rubber, and combinations thereof. In certain exemplary embodiments, the second discontinuous polymer phase comprises a crystalline polymer or a thermoplastic polymer. In some exemplary embodiments, the second discontinuous polymer phase comprises at least one of a polyolefin, a cyclic polyolefin, or a polyolefinic thermoplastic elastomer. In some particular exemplary embodiments, the polyolefin is selected from polyethylene, polypropylene, polybutylene, polyisobutylene, polyoctene, copolymers thereof, and combinations thereof.

In other embodiments, a plurality of pores is created in at least some of the polishing elements by at least partially removing at least a portion of the second discontinuous polymer phase 15 from at least a portion of the polishing elements 4 of polishing pad 2-2', thereby leaving a void or pore volume corresponding to the volume previously occupied by the second discontinuous polymer phase 15. In some exemplary embodiments, the second discontinuous polymer phase may be soluble in a solvent in which the first continuous polymer phase 13 is substantially insoluble or only partially soluble.

In some exemplary embodiments, the second discontinuous polymer phase comprises a water soluble, water swellable or hydrophilic thermoplastic polymer, and water or an aqueous solvent is used to dissolve and thereby remove at least a portion of the second discontinuous polymer phase 15 from one or more polishing elements 4, thereby creating one or more porous polishing elements. Suitable water soluble polymers include poly(ethylene oxide), poly(vinyl alcohol), poly(vinyl pyrollidone), polyacrylic acid, poly(meth)acrylic acid, copolymers thereof with other monomers, and combinations thereof.

In certain exemplary embodiments, the aqueous solvent is selected to be the working liquid used in a chemical mechanical polishing process, and this working liquid is used to dissolve and thereby remove at least a portion of the second discontinuous polymer phase 15 from one or more polishing elements 4, thereby creating one or more porous polishing elements.

In further exemplary embodiments of polishing pads as described above, the second discontinuous polymer phase comprises from about 1%, 2.5%, 5%, or 10%; to about 50%, 60%, 70%, 80%, or 90% by weight of each polishing element. In additional exemplary embodiments, the second discontinuous polymer phase comprises from about 5% to about 90% by weight of each polishing element. In certain exemplary embodiments, the second discontinuous polymer phase is characterized by at least one of a length from 5 to 5,000 μm, a width from 5 to 250 μM, an equivalent spherical diameter of from 5 to 100 μm, or a combination thereof. Preferably, the volume defined by the second discontinuous polymer phase domains has a substantially uniform spherical shape, and exhibits a median diameter of at least 1 μm, 5 μm, 10 μm, 20 μm, 30 μm, 40 μm, 50 μm; and at most 200 μm, 150 μm, 100 μm, 90 μm, 80 μm, 70 μm, or 60 μm.

In further exemplary embodiments of any of the polishing pads described above, the sheet 13', support layer 10 or textured polishing pad may be substantially incompressible, such as a rigid film or other hard substrate, but is preferably compressible to provide a positive pressure directed toward the polishing surface. In some exemplary embodiments, the sheet or support layer may comprise a flexible and compliant material, such as a compliant rubber or polymer. In other exemplary embodiments, the sheet, support layer or pad is preferably made of a compressible polymeric material, foamed polymeric materials being preferred. In certain embodiments, closed cell foams may be preferred, although in other embodiments, and open cell foam may be used. In additional exemplary embodiments, the polishing elements may be formed with the support layer as a unitary sheet of polishing elements affixed to the support layer, which may be a compressible or compliant support layer.

The sheet or support layer is preferably liquid impermeable, to prevent penetration or permeation of a working liquid into or through the support layer. However, in some embodiments, the sheet or support layer may comprise liquid permeable materials, alone or in combination with an optional barrier that acts to prevent or inhibit liquid penetration or permeation through the support layer. Furthermore, in other embodiments, a porous sheet or support layer may be used advantageously, for example, to retain a working liquid (e.g. a polishing slurry) at the interface between the polishing pad and a workpiece during polishing.

In certain exemplary embodiments, the sheet or support layer may comprise a polymeric material selected from silicone, natural rubber, styrene-butadiene rubber, neoprene, polyurethane, polyester, polyethylene, and combinations thereof. The sheet or support layer may further comprise a wide variety of additional materials, such as fillers, particulates, fibers, reinforcing agents, and the like.

Polyurethanes have been found to be particularly useful sheet or support layer materials, with thermoplastic polyurethanes (TPUs) being particularly preferred. In some presently preferred embodiments, the support layer is a film comprising one or more TPU, for example, an ESTANE TPU (available from Lubrizol Advanced Materials, Inc., Cleveland, Ohio), a TEXIN or DESMOPAN TPU (available from Bayer Material Science, Pittsburgh, Pa.), a PELLETHANE TPU (available from Dow Chemical Company, Midland, Mich.), and the like.

In some exemplary embodiments, the polishing pad further comprises a compliant layer 16 affixed to the support layer opposite the polishing elements. The compliant layer may be affixed to the support layer by any means of bonding surfaces, but preferably, an adhesive layer positioned at an interface between the compliant layer and the support layer is used to affix the support layer to the compliant layer opposite the polishing elements.

In certain embodiments, the compliant layer is preferably compressible to provide a positive pressure directing the polishing surfaces of the polishing elements toward a workpiece during polishing. In some exemplary embodiments, the support layer may comprise a flexible and compliant material, such as a compliant rubber or polymer. In other exemplary embodiments, the support layer is preferably made of a compressible polymeric material, foamed polymeric materials being preferred. In certain embodiments, closed cell foams may be preferred, although in other embodiments, and open cell foam may be used.

In some particular embodiments, the compliant layer may comprise a polymeric material selected from silicone, natural rubber, styrene-butadiene rubber, neoprene, polyurethane, polyethylene and its copolymers, and combinations thereof. The compliant layer may further comprise a wide variety of additional materials, such as fillers, particulates, fibers, reinforcing agents, and the like. The compliant layer is preferably liquid impermeable (although permeable materials may be used in combination with an optional barrier to prevent or inhibit liquid penetration into the compliant layer.

Presently preferred polymeric materials for use in the compliant layer are polyurethanes, with TPUs being particularly preferred. Suitable polyurethanes include, for example, those available under the trade designation PORON from Rogers Corp., Rogers, Conn., as well as those available under the trade designation PELLETHANE from Dow Chemical, Midland, Mich., particularly PELLETHANE 2102-65D. Other suitable materials include polyethylene terepthalates (PET), such as, for example biaxially oriented PET widely available under the trade designation MYLAR, as well as bonded rubber sheets (e.g. rubber sheets available from Rubberite Cypress Sponge Rubber Products, Inc., Santa Ana, Calif., under the trade designation BONDTEX).

In some exemplary embodiments, polishing pads 2-2' according to the present disclosure may have certain advantages when used in a CMP process, for example, improved within wafer polishing uniformity, a flatter polished wafer surface, an increase in edge die yield from the wafer, and improved CMP process operating latitude and consistency. While not wishing to be bound by any particular theory, these advantages may result from decoupling of the polishing surfaces of the polishing elements from the compliant layer underlying the support layer, thereby allowing the polishing elements to "float" in a direction substantially normal to the polishing surface of the elements when contacting the polishing pad to a workpiece during a polishing process.

In some embodiments of polishing pads 2', decoupling of the polishing surfaces of the polishing elements from the compliant underlayer may be augmented by incorporating into the polishing article an optional guide plate 28 including a plurality of apertures extending through the guide plate from a first major surface to a second major surface, wherein at least a portion of each polishing element extends into a corresponding aperture, and wherein each polishing element extends outwardly from the second major surface of the guide plate. The optional guide plate, which preferably comprises a stiff or non-compliant material, may be used to maintain the spatial orientation of polishing surface, as well as to maintain lateral movement of the elements on the polishing pad. In other embodiments, however, the optional guide plate is not required, because the spatial orientation of the polishing elements is maintained and lateral movement is prevented by bonding the elements to the support layer, preferably by thermally bonding the polishing elements directly to the support layer.

The optional guide plate 28 can be made of a wide variety of materials, such as polymers, copolymers, polymer blends, polymer composites, or combinations thereof. A rigid, non-compliant, non-conducting and liquid impermeable polymeric material is generally preferred, and polycarbonates have been found to be particularly useful.

In further embodiments, polishing pads of the present disclosure may further comprise an optional polishing composition distribution layer 8-8' covering at least a portion of a first major side of the sheet or support layer, as well as the first major surface of the optional guide plate (if present). The optional polishing composition distribution layer may be made of a wide variety of polymeric materials. The optional polishing composition distribution layer may, in some embodiments, comprise at least one hydrophilic polymer. Preferred hydrophilic polymers include polyurethanes, polyacrylates, polyvinyl alcohols, polyoxymethylenes, and combinations thereof. In one particular embodiment, the polishing composition layer may comprise a hydrogel material, such as, for example a hydrophilic polyurethane or polyacrylate, that can absorb water, preferably in a range of about 5 to about 60 percent by weight, to provide a lubricious surface during polishing operations.

In additional exemplary embodiments, the optional polishing composition distribution layer comprises a compliant material, for example, a porous polymer or foam, to provide a positive pressure directed toward to substrate during polishing operations when the polishing composition distribution layer is compressed. In certain exemplary embodiments, the compliance of the polishing composition distribution layer is selected to be less than the compliance of the optional compliant layer. Porous or foamed materials with open or closed cells may be preferred compliant materials for use in an optional polishing composition distribution layer in certain embodiments. In some particular embodiments, the optional polishing composition distribution layer has between about 10 and about 90 percent porosity.

In certain exemplary embodiments, the compliant layer is affixed to the second major side by an adhesive layer at an interface between the compliant layer and the second major side.

In further exemplary embodiments, the polishing surfaces of the polishing elements may be made flush with or recessed below the exposed major surface of the optional polishing composition distribution layer. Such embodiments may be advantageously employed to maintain a working liquid, for example a polishing slurry, at the interface between the exposed polishing surfaces of the polishing elements and a workpiece. In such embodiments, the polishing composition distribution may be advantageously selected to comprise a material that is abraded or eroded during the polishing process or in optional conditioning processes applied to the polishing surface of the polishing pad before, during, or after contact with a workpiece.

In additional exemplary embodiments, the polishing composition distribution layer may act to substantially uniformly distribute a polishing composition across the surface of the substrate undergoing polishing, which may provide more uniform polishing. The polishing composition distribution layer may optionally include flow resistant elements such as baffles, grooves (not shown in the figures), pores, and the like, to regulate the flow rate of the polishing composition during polishing. In further exemplary embodiments, the polishing composition distribution layer can include various layers of different materials to achieve desired polishing composition flow rates at varying depths from the polishing surface.

In some exemplary embodiments, one or more of the polishing elements may include an open core region or cavity defined within the polishing element, although such an arrangement is not required. In some embodiments, as described in PCT International Pub. No. WO 2006/055720, the core of the polishing element can include sensors to detect pressure, conductivity, capacitance, eddy currents, and the like. In yet another embodiment, the polishing pad may include a window extending through the pad in the direction normal to the polishing surface, or may use transparent layers and/or transparent polishing elements, to allow for optical end-pointing of a polishing process, as described in PCT International Pub. No. WO 2009/140622.

The present disclosure is further directed to a method of using a polishing pad as described above in a polishing process, the method including contacting a surface of a substrate with a polishing surface of a polishing pad comprising a plurality of polishing elements, at least some of which are porous, and relatively moving the polishing pad with respect to the substrate to abrade the surface of the substrate. In certain exemplary embodiments, a working liquid may be provided to an interface between the polishing pad surface and the substrate surface. Suitable working liquids are known in the art, and may be found, for example, in U.S. Pat. Nos. 6,238,592 B1; 6,491,843 B1; and PCT International Pub. No. WO 2002/33736.

The polishing pads described herein may, in some embodiments, be relatively easy and inexpensive to manufacture. A brief discussion of some exemplary methods for making polishing pads according to the present disclosure is described below, which discussion is not intended to be exhaustive or otherwise limiting.

Thus, in another exemplary embodiment, the present disclosure provides a method of making polishing pads as described above, the method including mixing a first polymer with a second polymer with application of heat to form a fluid molding composition, dispensing the fluid molding composition into a mold, cooling the fluid molding composition to form a polishing pad including a first continuous polymer phase comprising the first polymer, and a second discontinuous polymer phase comprising the second polymer, wherein the polishing pad has a first major side or surface and a second major side or surface opposite the first major side or surface.

In some exemplary embodiments, dispersing the first polymer in the second polymer comprises melt mixing, kneading, extrusion, or combinations thereof. In certain exemplary embodiments, dispensing the fluid molding composition into the mold comprises at least one of reaction injection molding, extrusion molding, compression molding, vacuum molding, or a combination thereof. In some particular exemplary embodiments, dispensing comprises continuously extruding the fluid molding composition through a film die onto a casting roller, further wherein the surface of the casting roller comprises the mold.

In additional exemplary embodiments of making a textured polishing pad as described above, the method further includes milling at least one of the first and second major sides to form a multiplicity of grooves extending into the side. In certain exemplary embodiments, the grooves have a depth of from about 1 μm to about 5,000 μm. In some particular exemplary embodiments, the polishing pad has a circular cross-section in a direction substantially normal to the first and second sides, wherein the circle defines a radial direction, and further wherein the plurality of grooves are circular, concentric, and spaced apart in the radial direction.

In an alternative exemplary embodiment of making a polishing pad 2 as described above, the mold includes comprises a three-dimensional pattern, and the first major surface comprises a multiplicity of polishing elements corresponding to an impression of the three-dimensional pattern, wherein the plurality of polishing elements extend outwardly from the first major side along a first direction substantially normal to the first major side, further wherein the polishing elements are integrally formed with the sheet and laterally connected so as to restrict lateral movement of the polishing elements with respect to one or more of the other polishing elements, but remaining moveable in an axis substantially normal to a polishing surface of the polishing elements.

The plurality of polishing elements may be formed from a molten polymer or composite sheet of polymeric film using, for example, extrusion molding or compression molding, respectively. To generate the polishing elements using extrusion molding, a mixture of two different molten polymers capable of undergoing phase separation on cooling could be fed into a twin screw extruder equipped with a film die and casting rolls possessing the desired pre-determined pattern of polishing elements. Alternatively, a phase separated polymeric film could be made and compression molded in a second operation with molding plates possessing the desired pre-determined pattern of polishing elements. Upon creation of the desired pattern of polishing elements on the sheet, the sheet could be secured to a compliant support layer, for example, by thermal bonding to a thermal bonding film or by use of an adhesive. Alternatively, the compliant support layer could be laminated to the back side of the polishing surface or support layer during film casting or compression molding.

In one particularly advantageous embodiment illustrating a unitary polishing pad, a multi-cavity mold may be provided with a back-fill chamber, wherein each cavity corresponds to a polishing element. A plurality of polishing elements, which may include porous polishing elements and nonporous polishing element as described herein, may be formed by injection molding a suitable polymer melt into the multi-cavity mold, and back-filling the back-fill chamber with the same polymer melt or another polymer melt to form a support layer. The polishing elements remain affixed to the support layer upon cooling of the mold, thereby forming a plurality of polishing elements as a unitary sheet of polishing elements with the support layer. The mold may, in some embodiments, comprise a rotating roll mold.

In another embodiment, the integrally molded sheet of polishing elements could be scored between the individual raised polishing elements to generate a polishing surface of individually floating polishing elements. Alternatively, the segregation could also be accomplished in the molding process by incorporating raised areas in the mold between the individual raised elements.

Suitable molding materials, molds, apparatus and methods of forming an integral sheet of polishing elements are described in the Examples below and in PCT International Pub. No. WO 2009/158665.

In a further alternative embodiment, the present disclosure provides a method of making a polishing pad 2' as described above, the method including forming a multiplicity of polishing elements including a first continuous polymer phase comprising a first polymer and a second discontinuous polymer phase comprising a second polymer, and bonding the polishing elements to a first major side of a support layer having a second major side opposite the first major side to form a polishing pad. In some exemplary embodiments, the method further includes affixing a compliant layer to the second major side. In further exemplary embodiments, the method further includes affixing a polishing composition distribution layer covering at least a portion of the first major side.

In some exemplary embodiments, the method additionally includes forming a pattern with the polishing elements on the first major side. In certain exemplary embodiments, forming a pattern comprises reaction injection molding the polishing elements in the pattern, extrusion molding the polishing elements in the pattern, compression molding the polishing elements in the pattern, arranging the polishing elements within a template corresponding to the pattern, or arranging the polishing elements on the support layer in the pattern. In some particular exemplary embodiments, bonding the polishing elements to the support layer comprises thermal bonding, ultrasonic bonding, actinic radiation bonding, adhesive bonding, and combinations thereof.

In certain presently preferred embodiments, the polishing elements are thermally bonded to the support layer. Thermal bonding may be achieved, for example, by contacting a major surface of the support layer with a surface of each polishing element to form a bonding interface, and heating the polishing elements and the support layer to a temperature at which the polishing elements and support layer soften, melt, or flow together to form a bond at the bonding interface. Ultrasonic welding may also be used to effect thermal bonding of the polishing elements to the support layer. In some presently preferred embodiments, pressure is applied to the bonding interface while heating the polishing elements and the support layer. In further presently preferred embodiments, the support layer is heated to a temperature greater than the temperature to which the polishing elements are heated.

In other exemplary embodiments, bonding the polishing elements to the support layer involves using a bonding material that forms a physical and/or chemical union at an interface between the polishing elements and a major surface of the support layer. Such a physical and/or chemical union may, in certain embodiments, be formed using an adhesive positioned at the bonding interface between each polishing element and the major surface of the support layer. In other embodiments, the bonding material may be a material that forms a bond by curing, for example, by thermally curing, radiation curing (e.g. curing using actinic radiation such as ultraviolet light, visible light, infrared light, electron beams or other radiation sources), and the like.

Suitable bonding film materials, apparatus and methods are described in PCT International Pub. No. WO 2010/009420.

In additional presently preferred exemplary embodiments, at least a portion of the polishing elements comprise porous polishing elements. In some exemplary embodiments, at least some of the polishing elements comprise substantially non-porous polishing elements. In some particular exemplary embodiments, the porous polishing elements are formed by injection molding of a gas saturated polymer melt, injection molding of a reactive mixture that evolves a gas upon reaction to form a polymer, injection molding of a mixture comprising a polymer dissolved in a supercritical gas, injection molding of a mixture of incompatible polymers in a solvent, injection molding of porous thermoset particulates dispersed in a thermoplastic polymer, injection molding of a mixture comprising microballoons, and combinations thereof. In additional exemplary embodiments, the pores are formed by reaction injection molding, gas dispersion foaming, and combinations thereof.

In some exemplary embodiments, the porous polishing elements have pores distributed substantially throughout the entire polishing element. In other embodiments, the pores may be distributed substantially at the polishing surface of the porous polishing elements. In some additional embodiments, the porosity imparted to the polishing surface of a porous polishing element may be imparted, for example, by injection molding, calendaring, mechanical drilling, laser drilling, needle punching, gas dispersion foaming, chemical processing, and combinations thereof.

It will be understood that the polishing pad need not comprise only substantially identical polishing elements. Thus, for example, any combination or arrangement of porous polishing elements and non-porous polishing elements may make up the plurality of porous polishing elements. It will also be understood that any number, combination or arrangement of porous polishing elements and substantially nonporous polishing elements may be used advantageously in certain embodiments to form a polishing pad having floating polishing elements bonded to a support layer.

In further exemplary embodiments, the polishing elements may be arranged to form a pattern. Any pattern may be advantageously employed. For example, the polishing elements may be arranged to form a two-dimensional array, for example, a rectangular, triangular, or circular array of polishing elements. In additional exemplary embodiments, the polishing elements may include both porous polishing elements and substantially nonporous polishing elements arranged in a pattern on the support layer. In certain exemplary embodiments, the porous polishing elements may be advantageously arranged with respect to any substantially nonporous polishing elements to form an arrangement of porous polishing elements and nonporous polishing elements on the major surface of the support layer. In such embodiments, the number and arrangement of porous polishing elements relative to substantially nonporous polishing elements may be selected advantageously to obtain desirable polishing performance.

For example, in some exemplary embodiments, porous polishing elements may be arranged substantially near the center of a major surface of the polishing pad, and substantially nonporous polishing elements may be arranged substantially near the peripheral edge of the major surface of the polishing pad. Such exemplary embodiments may desirably more effectively retain a working liquid, for example an abrasive polishing slurry, in the contact zone between the polishing pad and the wafer surface, thereby improving wafer surface polishing uniformity (e.g. reduced dishing at the wafer surface) as well as reducing the quantity of waste slurry generated by the CMP process. Such exemplary embodiments may also desirably provide more aggressive polishing at the edges of the die, thereby reducing or eliminating the formation of an edge ridge, and improving yield and die polish uniformity.

In other exemplary embodiments, porous polishing elements may be arranged substantially near the edge of a major surface of the polishing pad, and substantially nonporous polishing elements may be arranged substantially near the center of the major surface of the polishing pad. Other arrangements and/or patterns of polishing elements are contemplated as falling within the scope of the present disclosure.

In certain embodiments of making a polishing pad 2' as described above, the polishing elements may be arranged in a pattern by placement on a major surface of the support layer. In other exemplary embodiments, the polishing elements may be arranged in a pattern using a template of the desired pattern, and the support layer may be positioned over or under the polishing elements and the template prior to bonding, with a major surface of the support layer contacting each polishing element at a bonding interface.

Exemplary embodiments of polishing pads having polishing elements according to the present disclosure may have various features and characteristics that enable their use in a variety of polishing applications. In some presently preferred embodiments, polishing pads of the present disclosure may be particularly well suited for chemical mechanical planarization (CMP) of wafers used in manufacturing integrated circuits and semiconductor devices. In certain exemplary embodiments, the polishing pad described in this disclosure may provide advantages over polishing pads that are known in the art.

For example, in some exemplary embodiments, a polishing pad according to the present disclosure may act to better retain a working liquid used in the CMP process at the interface between the polishing surface of the pad and the substrate surface being polished, thereby improving the effectiveness of the working liquid in augmenting polishing. In other exemplary embodiments, a polishing pad according to the present disclosure may reduce or eliminate dishing and/or edge erosion of the wafer surface during polishing. In some exemplary embodiments, use of a polishing pad according to the present disclosure in a CMP process may result in improved within wafer polishing uniformity, a flatter polished wafer surface, an increase in edge die yield from the wafer, and improved CMP process operating latitude and consistency.

In further exemplary embodiments, use of a polishing pad with porous elements according to exemplary embodiments of the present disclosure may permit processing of larger diameter wafers while maintaining the required degree of surface uniformity to obtain high chip yield, processing of more wafers before conditioning of the pad surface is required in order to maintain polishing uniformity of the wafer surface, or reducing process time and wear on the pad conditioner.

Another advantage of using phase-separated polymer blends for textured polishing pads is the apparent ease of machining or milling of the surface. Commercially available CMP pads are typically composed of cross-linked polyurethane foams which resist milling, and which are extremely difficult to mill without tearing or damaging the foam. A solid thermoplastic textured polishing pad material as described herein deforms less during the milling operations, therefore making it easier to mill and to generate a clean surface.

Exemplary polishing pads according to the present disclosure will now be illustrated with reference to the following non-limiting examples.

EXAMPLES

The following non-limiting examples illustrate various methods for preparing polishing pads comprising a plurality of polishing elements, or a textured polishing pad, as described above.

Example 1

Fabrication of a polishing pad 2 according to an exemplary embodiment of the present disclosure was conducted in a three step process: extrusion of a polymeric blend to form a polymeric film, compression molding several sheets of the polymeric film into a composite sheet having three dimensional polishing element structures, and laminating the composite film to a compliant layer comprising a foam material.

The extrusion process was carried out as follows. Pellets of a thermoplastic polyurethane, Estane® 58144 (from Lubrizol Corporation, Wickliffe, Ohio), were pre-mixed with pellets of a very low density polyethylene-butylene copolymer resin, Flexomer DFDB-1085 NT (from Dow Chemical Co, Midland, Mich.). The 80/20 (wt. %) mixture of Estane® 58144/Flexomer DFDB-1085 NT was placed into the hopper of a co-rotating Berstorff twin screw extruder (model EO 9340/91 from Krauss-Maffei Berstorff GmbH, Hanover, Germany). A melt pump and 12 inch (30.5 cm) wide film die were attached to the output end of the extruder. Extrusion conditions were as follows: 215° C. for all zones and the melt pump, a screw speed of 300 rpm, a pellet feed-rate of 20 lbs/hr (9.1 kg/hr) and a 3/1 melt pump outlet/inlet pressure differential. Film from the die was cast onto an 18 inch (45.7 cm) diameter, matte finish cast roll set at 104° C. The casting roll speed and extruder melt pump speed were set such that a 500 μm thick film was cast.

Sheets of the film were cut into approximately 4 inch×4 inch (10.2 cm×10.2 cm) square pieces. Three film pieces were stacked one on top of the other, with the corners of the pieces aligned. The stacked film pieces were placed between the top and bottom aluminum plates of a compression mold bearing a pre-determined pattern corresponding to the desired size and shape of polishing elements. The bottom plate was approximately 4 inch×4 inch (10.2 cm×10.2 cm) square and about 6 mm thick. The bottom plate was etched to comprise a square array of truncated, conical shaped features. The conical features had a diameter of 7.5 mm at the base and a diameter of 6.5 mm at the cavity bottom. The feature depth was about 2 mm. The truncated, conical shaped features were spaced about 11 mm on center, leaving an approximate 4 mm land region between the features. The total bearing area of the features represented about 50% of the area of the plate. The circumferences of the truncated, conical features in the cavity bottom were chamfered. The top plate was 4 inch×4 inch (10.2 cm×10.2 cm) square and about 1.5 mm thick.

The mold with film pieces was place between the platens of a hydraulic press (model number AP-22 from Pasadena Hydraulics, Inc., El Monte, Calif.). The compression molding was conducted at a temperature of 232° C. and a pressure of about 7.0 kg/cm$^2$ for 30 seconds. After compression molding, the mold was removed from the press and allowed to cool at room temperature. The resulting composite film, having three dimensional structures approximately the size and shape of the conical structures of the mold, was then removed from mold.

The composite film was hand laminated to a 4 inch×4 inch (10.2 cm×10.2 cm) square sheet of VOLTEC VOLARA Type EO foam 12 pounds per cubic foot (from Voltek, a division of Sekisui America Corp., Lawrence, Mass.) using a pressure sensitive adhesive (3M Adhesive Transfer Tape 9671 from the 3M Company, St. Paul, Minn.), forming a polishing pad 2' of the present disclosure.

Scanning electron microscopy was conducted on cross sections of the extruded film and the compression molded, composite film using standard techniques. Results revealed a two phase morphological structure with a discrete, discontinuous minor phase encompassed by a major continuous phase. Surprisingly, the phase morphology didn't change through the pressing process in either the highly compressed areas (land area) or in the post area. The shape and size of the minor phase domains appeared to be approximately spherical with a diameter of about 10 μm. Similar morphology was observed for both the extruded film and composite film.

Example 2

Fabrication of a polishing pad 2 according to an exemplary embodiment of the present disclosure was conducted in a three step process: extrusion of a polymeric blend to form a polymeric film, compression molding a sheet of the polymeric film into a film having three dimensional structures and laminating the composite film to a compliant layer comprising a foam material.

The extrusion process was carried out as follows. The pellet blend was identical to Example 1. It was placed into the hopper of a counter-rotating Davis-Standard twin screw extruder (model D-TEX 47 from Davis-Standard, LLC, Pawcatuck, Conn.). A melt pump and 91.5 cm wide film die were attached to the output end of the extruder. Extrusions conditions were as follows: 205° C. for all zones and melt pump, a screw speed of 200 rpm, a pellet feed-rate of 250 lb/hr (113 kg/hr) and a 2/1 melt pump outlet/inlet pressure differential. Film from the die was drop cast between an 8 inch (20.3 cm) diameter chrome cast roll set at 50° C. and an 8 inch (20.3 cm) chill roll diameter set at 50° C. The cast roll speed and extruder melt pump speed were set such that a 1,170 μm thick film was cast.

A 30 cm×30 cm sheet of film was cut, placed on a Teflon® film lined aluminum plate of similar length and width and heated in an air flow through oven set at 250° C. for 9 minutes. After removing from the oven, a Teflon® coated metal screen about 12 inch×12 inch (30.5 cm×30.5 cm) and about 0.0625 inch (1.6 mm) in thickness, having a hexagonal array of circular holes each about 6.2 mm in diameter and a center to center distance of about 8 mm (the total bearing area of the features represented about 58% of the area of the screen), was placed on top of the film sheet.

A Teflon® sheet was subsequently placed on top of the screen. While the film sheet was still hot, the entire stack, including the screen, was run through a two roll laminator having rubber rolls loaded to 0.23 kg/cm (mass per lineal inch of film width) and a speed of 0.9 m/min. This molding procedure created three dimensional structures in the film sheet, the structures being of similar size, shape and distribution as that of the holes in the metal screen. After molding, the film was allowed to cool to room temperature and removed from the metal screen. Four film samples with three dimensional structures were prepared in this fashion.

The four films with three dimensional structure were assembled in a 60 cm×60 cm square and hand laminated to a 60 cm×60 cm square sheet of Rogers PORON™ urethane foam, part #4704-50-20062-04 from American Flexible Products, Inc, Chaska, Minn., using a 127 μm thick transfer adhesive, 3M Adhesive Transfer Tape 9672 (from 3M Company), forming a polishing pad 2' of the present disclosure.

Scanning electron microscopy was conducted on cross sections of the extruded film and the compression molded, composite film using standard techniques. Results revealed a two phase morphological structure with a discrete, discontinuous minor phase encompassed by a continuous major phase. The shape and size of the minor phase domains appeared to be approximately spherical with a diameter of about 5 μm. Similar morphology was observed for both the extruded film and molded film.

Example 3

Fabrication of a polishing pad 2 according to an embodiment of the present disclosure was conducted in a three step process: extrusion of a polymeric blend to form a polymeric film, embossing a sheet of the polymeric film forming a film having three dimensional structures and laminating the composite film to a compliant layer comprising a foam material.

The extrusion process was as follows. The pellet blend was identical to Example 1. The extruder and extruder conditions were identical to that of Example 2, with the following changes. Film from the die was drop cast between an 8 inch (20.3 cm) diameter embossed roll set at 50° C. and an 8 inch (20.3 cm) chill roll set at 50° C. The embossed roll speed and extruder melt pump speed were set such that a 1,372 μm thick film was achieved. The pattern on the embossing roll was made up of a series of hexagonal shaped protrusions measuring approximately 3.5 mm wide and 715 μm in height. The channels between the hexagonal protrusions measured approximately 1 mm wide. The embossed film had hexagonal shaped depressions of approximately the same dimensions of that of the embossed roll. The bearing area of the embossed features represented about 40% of the area of the film.

A 60 cm×60 cm square sheet of the embossed film was hand laminated to a 60 cm×60 cm square sheet of Rogers PORON™ urethane foam part #4704-50-20062-04 (from American Flexible Products, Inc.) using a pressure sensitive adhesive, 3M Adhesive Transfer Tape 9671 (from 3M Company, St. Paul, Minn.), and die cut into a 51 cm circle forming the pad of the present disclosure.

Scanning electron microscopy was conducted on cross sections of the extruded film and the compression molded, composite film using standard techniques. Results revealed a two phase morphological structure with a discrete, discontinuous minor phase encompassed by a continuous major phase. The shape and size of the minor phase domains appeared to be approximately spherical with a diameter of about 5 μm. Similar morphology was observed for both the extruded film and composite film.

Example 4

Fabrication of a textured polishing pad according to an alternative embodiment of the present disclosure was conducted in a three step process: extrusion of a polymeric blend to form a polymeric film, milling of a plurality of concentric circular grooves spaced apart radially on the surface of a major side of the polymeric film, and laminating the composite film to a compliant layer comprising a foam material.

The polishing surface was generated by milling a cast film of 80% Estane 58144 thermoplastic polyurethane and 20% Dow Flexomer™ DFDB-1085 polyethylene-butylene copolymer as prepared in Example 1. Scanning electron microscopy was conducted on cross sections of the extruded composite film using standard techniques. Results revealed a two phase morphological structure with a discrete, discontinuous minor phase encompassed by a continuous major phase. The shape and size of the minor phase domains appeared to be approximately spherical with a diameter between about 2 and 5 microns.

The milled surface was created by mounting a piece of cast film on a vertical end mill (Mini Lathe, Central Machinery, Taiwan), rotating the piece at 1500 rpm and plunge cutting grooves with a shaped cutting tool. The groove depth and width were 915 and 500 μm, respectively.

To complete the construction, the milled film was laminate with a 127 μm transfer adhesive (3M 9672 adhesive, St Paul, Minn.) and adhered to a 15 cm diameter, 1.59 mm thick polyurethane foam (Rogers Poron urethane foam, Part#4701-50-20062-04, American Flexible, Chaska, Minn.).

The foregoing Examples 1-3 are directed to producing a polishing pad including a sheet having a first major side and a second major side opposite the first major side, and a multiplicity of polishing elements extending outwardly from the first major side along a first direction substantially normal to the first major side, wherein at least a portion of the polishing elements are integrally formed with the sheet and laterally connected so as to restrict lateral movement of the polishing elements with respect to one or more of the other polishing elements, but remaining moveable in an axis substantially normal to a polishing surface of the polishing elements, wherein at least a portion of the plurality of polishing elements comprise a first continuous polymer phase and a second discontinuous polymer phase. The foregoing Example 4 is directed to a textured polishing pad including a first continuous polymer phase and a second discontinuous polymer phase, wherein the polishing pad has a first major side and a second major side opposite the first major side, and further wherein at least one of the first and second major sides comprises a multiplicity of grooves in the surface.

However, it will be understood that any of the foregoing molded or roller embossed films of Examples 1-4 may be used to create polishing elements 4 for use in producing a polishing pad 2' including a support layer having a first major side and a second major side opposite the first major side, and a multiplicity of polishing elements bonded to the first major side of the support layer, wherein each polishing element has an exposed polishing surface, and wherein the polishing elements extend from the first major side of the support layer along a first direction substantially normal to the first major side, further wherein at least a portion of the plurality of polishing elements comprise a first continuous polymer phase and a second discontinuous polymer phase. The molded or embossed elements polishing may, for example be cut out of the film (e.g. using die cutting) and subsequently bonded to the first major side of the support layer, preferably using direct thermal bonding, as described above.

It will be further understood that the relative order and arrangement of elements in the exemplary polishing pads and methods may be varied without deviating from the scope of the disclosure. Thus, for example, the support layer may be placed on a temporary release layer and overlaid with a template bearing a desired patterns for the polishing elements before arranging the polishing elements in a two-dimensional array pattern in the template, and thermally bonding the polishing elements to an overlaid support layer (i.e. a thermal bonding film), for example, as described in PCT International Pub. No. WO 2010/009420.

It will also be understood that the relative order and arrangement of elements in the exemplary polishing pads and methods described above may be varied without deviating from the scope of the disclosure. It will be additionally understood that polishing pads of exemplary embodiments the present disclosure need not comprise only substantially identical polishing elements. Thus, for example, any combination or arrangement of porous polishing elements and non-porous polishing elements may make up the plurality of porous polishing elements. It will also be understood that any number, combination or arrangement of porous polishing elements and substantially nonporous polishing elements may be used advantageously in certain embodiments to form a polishing pad having floating polishing elements bonded to a support layer. Furthermore, porous polishing elements may be substituted for nonporous polishing elements in any number, arrangement or combination. Thus, using the teachings provided in the Detailed Description and Examples hereinabove, individual porous and optionally, nonporous polishing elements may be affixed to (or integrally formed with) a support layer to provide polishing pads of various additional embodiments of the present disclosure.

Lastly, it will be understood that polishing pads as disclosed herein may generally include optional elements disclosed herein in any combination, for example, an optional compliant layer affixed to the second major side with an optional adhesive layer, an optional pressure sensitive adhesive layer affixed to the compliant layer opposite the second major side, an optional guide plate (for polishing pad embodiments like 2'), an optional polishing composition distribution layer, and the like.

Reference throughout this specification to "one embodiment", "certain embodiments", "one or more embodiments" or "an embodiment", whether or not including the term "exemplary" preceding the term "embodiment", means that a particular feature, structure, material, or characteristic described in connection with the embodiment is included in at least one embodiment of the certain exemplary embodiments of the present disclosure. Thus, the appearances of the phrases such as "in one or more embodiments", "in certain embodiments", "in one embodiment" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g. 1 to 5 includes 1, 1.5, 2, 2.75, 3, 3.80, 4, and 5). In addition, all numbers used herein are assumed to be modified by the term 'about'. Furthermore, all publications and patents referenced herein are incorporated by reference in their entirety to the same extent as if each individual publication or patent was specifically and individually indicated to be incorporated by reference.

Various exemplary embodiments have been described. These and other embodiments are within the scope of the following claims.

The invention claimed is:

1. A polishing pad comprising:

a sheet having a first major side and a second major side opposite the first major side; and a plurality of polishing elements extending outwardly from the first major side along a first direction substantially normal to the first major side, wherein at least a portion of the polishing elements are integrally formed with the sheet and laterally connected so as to restrict lateral movement of the polishing elements with respect to one or more of the other polishing elements, but remaining moveable in an axis substantially normal to a polishing surface of the polishing elements, wherein at least a portion of the plurality of polishing elements comprise a first continuous polymer phase and a second discontinuous polymer phase, and at least one transparent polishing element affixed to a transparent portion of the sheet.

2. A polishing pad comprising:

a support layer having a first major side and a second major side opposite the first major side; and a plurality of polishing elements, wherein each polishing element is affixed to the first major side by bonding to the support layer and each polishing element has an exposed polishing surface, and wherein the polishing elements extend from the first major side of the support layer along a first direction substantially normal to the first major side, further wherein at least a portion of the plurality of polishing elements comprise a first continuous polymer phase and a second discontinuous polymer phase, wherein at least one of the polishing elements is a transparent polishing element.

3. The polishing pad of claim 2, wherein each polishing element is thermally bonded to the support layer.

4. The polishing pad of claim 2, wherein the support layer comprises a thermoplastic polyurethane.

5. The polishing pad of claim 1, wherein the second discontinuous polymer phase comprises a crystalline polymer, a thermoplastic polymer, a water soluble polymer, or a combination thereof.

6. The polishing pad of claim 5, wherein the second discontinuous polymer phase comprises at least one of a polyolefin, a cyclic polyolefin, a polyolefinic thermoplastic elastomer, poly(ethylene oxide), poly(vinyl alcohol), poly(vinyl pyrrolidone), polyacrylic acid, poly(meth)acrylic acid, and combinations thereof.

7. A method of making a polishing pad according to claim 2, comprising:

forming a plurality of polishing elements comprising a first continuous polymer phase comprising a first polymer, and a second discontinuous polymer phase comprising a second polymer; and bonding the polishing elements to a first major side of a support layer having a second major side opposite the first major side to form a polishing pad.

* * * * *